United States Patent [19]

Risser et al.

[11] 4,168,878

[45] Sep. 25, 1979

[54] PIN AND SOCKET TYPE ELECTRICAL TERMINALS

[75] Inventors: Peter H. Risser, Millersville; John A. Zimmerman, Jr., Hershey; Clarence L. Paullus, Lewisberry, all of Pa.

[73] Assignee: AMP Incorporated, Harrisburg, Pa.

[21] Appl. No.: 908,293

[22] Filed: May 22, 1978

[51] Int. Cl.[2] ..... H01R 13/10; H01R 13/42

[52] U.S. Cl. ..... 339/217 S; 339/115 C; 339/259 R

[58] Field of Search ..... 339/60 R, 60 C, 60 M, 339/94 R, 94 C, 94 M, 114, 115 R, 115 C, 116 R, 116 C, 217 S, 259 R; 308/5 R

[56] References Cited

U.S. PATENT DOCUMENTS

| | | | |
|---|---|---|---|
| 2,210,827 | 8/1940 | Zaborsky | 339/115 R |
| 2,367,836 | 1/1945 | Brown | 308/5 R |
| 2,623,085 | 12/1952 | Gier, Jr. | 339/116 R |
| 2,860,316 | 11/1958 | Watters et al. | 339/259 R |
| 3,009,130 | 11/1961 | Redslob et al. | 339/259 R |
| 3,316,528 | 4/1967 | Juris et al. | 339/259 |
| 3,327,282 | 6/1967 | Krolak | 339/63 |
| 3,544,954 | 12/1970 | Yeager | 339/217 |

*Primary Examiner*—Neil Abrams
*Attorney, Agent, or Firm*—Russell J. Egan

[57] ABSTRACT

Improved pin and socket type electrical terminals are disclosed. Each terminal includes a terminal body received in a tubular sleeve of metal having low corrosion characteristics, such as stainless steel. The tubular sleeves are secured to the respective terminal bodies by a first annular crimp intermediate the ends of the sleeves and engaging in an annular recess in the respective bodies. The socket terminal body includes a plurality of cantilevered arms which are protected against damage from overstressing by the sleeve. A second annular crimp in the socket terminal sleeve is used to set the contact arms to control the normal force applied to a mating pin terminal. An annular pad of lubricant can be positioned within the end of the socket terminal sleeve and held in position by the ends of the arms.

4 Claims, 4 Drawing Figures

PIN AND SOCKET TYPE ELECTRICAL TERMINALS

BACKGROUND OF THE INVENTION

1. The Field Of The Invention

The present invention relates to an improved pin and socket type electrical terminal in which a main terminal body is enclosed within a seamless sleeve which is attached thereto by an annular crimp.

2. The Prior Art

It is well known that pin and socket type electrical terminals can be manufactured from either bar stock by conventional screw machine methods or by stamping and forming sheet metal. Generally the machine pin and socket terminals have been regarded as being of higher quality than stamped and formed terminals for the reasons that the stamped and formed terminals have an axially extending seam which is normally closed but which may not be fully closed if the part is not carefully made. Furthermore, in case of socket contacts, the axially extending seam may be forced open when a test probe or other foreign instrument is inserted into the contact or if the contact is mated with an oversize contact pin. These heretofore known disadvantages of the stamped and formed contact are discussed in U.S. Pat. No. 3,544,954 which poses one solution for these problems. The present invention constitutes an improvement over the terminals shown in said patent.

SUMMARY OF THE INVENTION

The present invention is directed to an improvement in the field of pin and socket type electrical terminals. Each terminal includes a body portion having a conductor gripping barrel on one end, a mating profile on the opposite end, and an annular recess intermediate the ends. A seamless metal sleeve receives the body portion therethrough and is secured thereon by a first annular crimp received in the annular recess. The body provides the mating portion and the conductor gripping portion while the sleeve provides protection against corrosion and terminal latching means. The sleeve of the socket terminal also has a second annular crimp to control the normal forces of cantilever contact arms forming the mating profile of the socket.

It is therefore an object of the present invention to produce improved pin and socket type electrical terminals, each having a body member received in a seamless sleeve providing corrosion protection and terminal latching.

It is another object of the present invention to produce an improved pin and socket type electrical terminal in which the socket terminal can include means for applying lubrication during mating of the terminals.

It is yet another object of the present invention to produce an electrical socket terminal having a seamless metal sleeve mounted on a terminal body to protect cantilever beam portions of the body forming a mating socket portion preventing the beams from being overstressed while assuring adequate normal forces are preserved.

It is a further object of the present invention to produce an improved pin and socket electrical terminal in which a socket terminal has a body portion including a plurality of cantilever contact arms which are received in a seamless sleeve with a first annular crimp securing the body and sleeve together and a second annular crimp setting the normal force of the cantilever contact arms.

It is a still further object of the present invention to produce an improved pin and socket type electrical terminal which can be readily and economically produced.

The means for accomplishing the foregoing objects and other advantages of the present invention will become apparent to those skilled in the art from the following detailed description taken with reference to the accompanying drawings.

DESCRIPTION OF THE PREFERRED EMBODIMENT

Figures 1, 2, 3, 4:
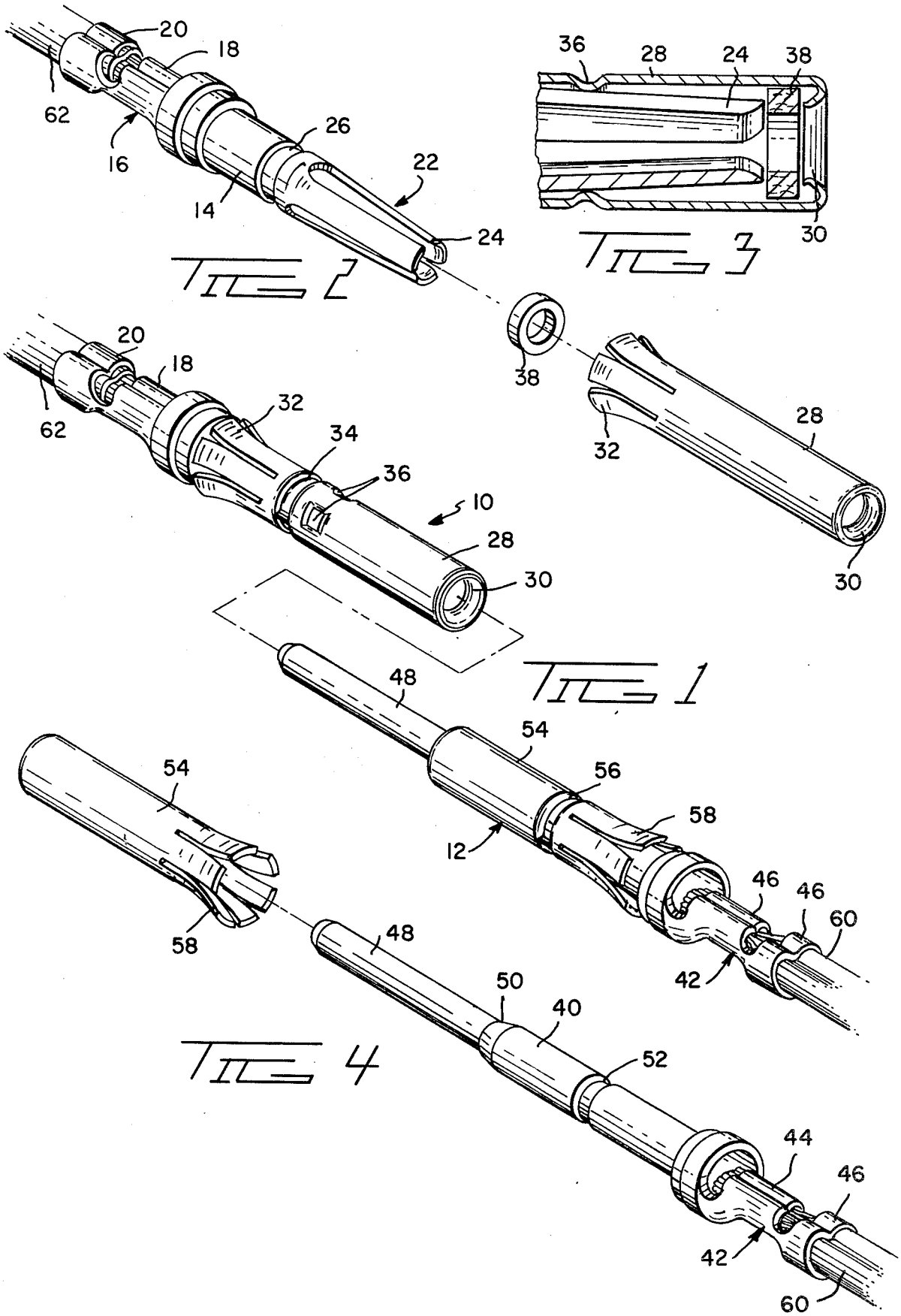
FIG. 1 is an exploded perspective view of the subject pin and socket terminals.
FIG. 2 is an exploded perspective view of the subject socket terminal.
FIG. 3 is a longitudinal section through the mating end of the socket terminal.
FIG. 4 is an exploded perspective view of the pin terminal according to the present invention.

The subject electrical terminal includes a socket terminal 10 and a mating pin terminal 12. The socket terminal includes an elongated contact body 14 having, on one end, a conductor engaging wire barrel portion 16 including a pair of conductor engaging ears 18 and a pair of insulation engaging strain relief ears 20. The opposite mating end 22 of the socket terminal includes a plurality of cantilever contact arms 24. The body also includes an annular recess 26 intermediate the ends thereof. The socket terminal 10 also includes a seamless cylindrical sleeve 28 having an inwardly curved flange 30 at the mating forward end and a plurality of outwardly bent latching tines 32 on the opposite end. The sleeve 28 is received over the body 14 with the cantilever contact arms 24 lying totally therein. The sleeve 28 is secured to the body 14 by a first annular crimp 34 which is received in the annular recess 26. A second annular crimp 36, spaced forwardly of the first annular crimp 34, is used to set the contact arms 24 to control the normal force applied thereby to a mating pin terminal received therein. This is best seen in FIG. 3. The socket terminal can also include an annular pad 38 of lubricating material which would be mounted in the end of sleeve 28 intermediate the free ends of the cantilever contact arms 24 and the flange 30 to be held in position thereby. The pad 38 would have an outer diameter substantially the same as the interior of the sleeve 28 and an interior diameter of sufficient depth to receive therein a mating portion of a pin terminal in wiping engagement.

The pin terminal 12 includes a body 40 having, on one end, a conductor engaging wire barrel 42 including a pair of conductor engaging tines 44 and insulation engaging strain relief tines 46. The mating end 48 of the pin terminal includes a stepped profile with a shoulder 50. The body also includes an annular recess 52 intermediate the ends of the body. A sleeve 54, similar to sleeve 28, is received over the pin body 40 with the inwardly directed flange (not shown) on the free end of the sleeve 54 engaging the intermediate shoulder 50 of the pin body 40. The sleeve 54 is secured to the body 40 by an annular crimp 56 which is received in the recess 52. The sleeve 54 also includes a plurality of latching tines 58.

The pin and socket terminals 12, 10, respectively, are mounted in an associated housing, not shown, in a conventional manner after having first been crimped to the stripped ends of associated conductors 60, 62. The tines 58, 32 will engage with appropriate detents or shoulders (also not shown) in the housings to hold the terminals in place.

Preferably the sleeves 28 and 54 are made of seamless stainless steel tubing, or other similar materials, to serve as corrosion prevention and also as anti-overstress for the cantilever beams in the socket portion. Forming the sleeves from seamless tubing prevents any unwanted spreading or enlargement of the socket contact arms which would lessen the effectiveness of the electrical contact made between mating terminals.

The present invention may be subject to many modifications and changes without departing from the spirit or essential characteristics thereof. The present embodiment should therefore be considered in all respects as illustrative and not restrictive of the scope of the invention.

What is claimed is:

1. In combination with an electrical terminal of the pin and socket type, each terminal having a body with a conductor engaging portion extending from a first end and a mating portion extending from the opposite end, an outwardly directed flange defining a shoulder between said ends, and an annular recess spaced from said shoulder towards said mating portion, the mating portion of said socket type terminal including a plurality of cantilever beams, a seamless sleeve of corrosion resistant material receiving at least part of said mating portion therein, said sleeve having an inwardly turned flange at one end and at least one outwardly directed locking lance at the other end, a first annular crimp in said sleeve intermediate the ends thereof engaging in said annular recess of said body securing said sleeve thereto, and a second annular crimp in said sleeve of said socket terminal spaced from said first crimp and acting to restrict outward movement of said mating portion to prevent overstress of the beams while assuring adequate contact forces.

2. An electrical terminal comprising:

a stamped and formed cylindrical body having a conductor engaging portion defined by an open channel shaped ferrule integral with and extending from one end of said body, said ferrule having a conductor engaging portion and an insulation engaging portion, said body being formed to include an outwardly directed shoulder and an annular recess spaced from said shoulder away from said ferrule, and a mating portion;

a seamless cylindrical sleeve of corrosion resistant material, said sleeve having an inwardly turned annular flange at one end and at least one outwardly directed latch on the opposite end, said sleeve being coaxially mounted on said body to enclose at least part of said mating portion, and a first annular crimp intermediate the ends of said sleeve and extending into said annular recess of said body to join said sleeve and said body together;

said mating portion being a socket terminal having a plurality of cantilever beams defining an annular receptacle, said beams lying fully within said sleeve without contacting the inturned end thereof, and a second annular crimp intermediate said first annular crimp and said one end setting the contact force of said beams and preventing overstressing thereof.

3. An electrical terminal according to claim 2 further comprising:

lubricant means interposed between a free end of said beams and said annular flange of said sleeve.

4. An electrical terminal according to claim 3 wherein:

said lubricant means comprises an annular pad impregnated with lubricant.

* * * * *